United States Patent [19]

Seidel

[11] Patent Number: 4,479,643

[45] Date of Patent: Oct. 30, 1984

[54] METHOD AND APPARATUS FOR TRANSFERRING NEWSPAPERS FROM POCKETS TO AN OVERLAPPED STREAM

[75] Inventor: Randy R. Seidel, Champlain, N.Y.

[73] Assignee: Harris Graphics Corporation, Melbourne, Fla.

[21] Appl. No.: 424,025

[22] Filed: Sep. 27, 1982

[51] Int. Cl.[3] ..... B65H 5/30

[52] U.S. Cl. ..... 270/55; 198/579; 198/410; 271/186

[58] Field of Search ..... 270/54–58; 198/644, 462, 579, 403–404, 408, 410, 411, 422–423; 271/184–187, DIG. 9, 243, 303

[56] References Cited

U.S. PATENT DOCUMENTS

| | | | |
|---|---|---|---|
| 2,461,573 | 2/1949 | Scweizer | 270/55 |
| 2,634,971 | 4/1953 | Schweizer | 270/55 |
| 2,892,627 | 6/1959 | Newhouse | 270/55 |
| 3,243,182 | 3/1966 | Dexter | 271/186 X |
| 3,773,319 | 11/1973 | Hottendorf | 271/186 |
| 3,825,246 | 7/1974 | Elia et al. | 270/58 |
| 3,874,649 | 4/1975 | Bryson et al. | 270/55 |
| 3,877,692 | 4/1975 | Kluge et al. | 270/55 |
| 3,951,399 | 4/1976 | Reist | 270/55 |
| 4,034,845 | 7/1977 | Honegger | 271/185 |
| 4,034,974 | 7/1977 | Maopolski | 270/55 |
| 4,373,710 | 2/1983 | Hansen et al. | 270/55 |

*Primary Examiner*—E. H. Eickholt
*Attorney, Agent, or Firm*—Yount & Tarolli

[57] ABSTRACT

Bottom opening pockets in a newspaper stuffing machine sequentially move newspapers to a transfer station at a first speed with closed edge portions of the newspapers downward and major sides of the newspapers on which headlines are printed facing in the direction of movement of the pockets. The pockets are sequentially opened and the closed or folded edge portion of each of the newspapers in turn moves into engagement with a receiving conveyor. The receiving conveyor accelerates the closed edge portion of a newspaper while the open or cut edge portion of the newspaper remains in a pocket and travels at a slower speed. This results in deflecting or bending of the newspaper. As the closed or folded edge portion of the newspaper is accelerated, the paper is moved into an underlapped relationship with an immediately preceding newspaper. The underlapped newspapers are moved into an overlapped relationship by an inverter. An outlet conveyor transports a stream of the overlapped newspapers from the inverter to a receiving location with the closed or folded edge portion of each of the newspapers leading and with the headline sides of the newspapers facing downwardly.

17 Claims, 9 Drawing Figures

METHOD AND APPARATUS FOR TRANSFERRING NEWSPAPERS FROM POCKETS TO AN OVERLAPPED STREAM

BACKGROUND OF THE INVENTION

The present invention relates to method and apparatus for transferring newspapers from pockets of a newspaper stuffing machine into an overlapped stream with a closed edge portion of each of the newspapers leading and a headline side of each of the newspapers facing downwardly.

Machines for assembling or stuffing newspapers and similar articles are disclosed in U.S. Pat. Nos. 2,461,573 and 2,634,971. During operation of these machines, newspapers are transferred from bottom opening pockets into an overlapped stream on a conveyor with cut or open edge portions of the newspapers leading. Since the open edge portions of the newspapers are leading, difficulty has been encountered in using known machines to stack the newspapers. Therefore, the newspapers are frequently manually handled in order to stack them.

Another known newspaper stuffing machine is disclosed in U.S. Pat. No. 3,874,649. This machine discharges the newspapers into an overlapped stream on a conveyor belt with the folded or closed edge portions of the newspapers leading. Since the folded edge portions of the newspapers are leading, known stacking machines can be used to stack the newspapers.

Although the newspaper stuffing machines disclosed in the foregoing patents are more or less satisfactory in their general mode of operation, difficulty may be encountered when the operating speed of a stuffing machine is increased in order to increase the rate at which newspapers are assembled. When the operating speed of these known machines is increased, care must be taken to prevent the outer pages or jackets of the newspapers from being torn or displaced during relatively rapid movement of the newspapers as they are discharged from the stuffing machine. In addition, during high speed operation of a stuffing machine, the newspapers must be discharged from the machine in a controlled manner in order to have the newspapers follow an intended path of movement and/or to have an intended orientation after they have been discharged from the machine.

SUMMARY OF THE PRESENT INVENTION

The present invention provides a new and improved method and apparatus for transferring newspapers from pockets of a high speed stuffing machine into an overlapped stream with a closed edge portion of each of the newspapers leading and with a headline side of each of the newspapers facing downwardly. The downwardly facing headline sides of the newspapers are accessible to an address label applicator disposed beneath the stream of newspapers. Since the stream of newspapers is in an overlapped relationship with closed edge portions of the newspapers leading, the addressed newspapers can be readily stacked with known equipment.

During operation of the stuffing machine, newspapers sequentially move into a transfer station at a relatively high speed with the headline side of each of the newspapers facing in the direction of movement of the pockets. Upon opening of a stuffing machine pocket, a closed edge portion of a newspaper moves out of the pocket into engagement with a downwardly sloping conveyor. This conveyor accelerates the closed edge portion of the newspaper while the trailing edge portion of the newspaper remains in the open pocket. The newspaper is held against movement from its intended path by engagement of the enclosed or cut edge portion of the newspaper with the side of the pocket while the closed or folded edge portion of the newspaper is being accelerated.

The headline side of the newspaper is moved into abutting engagement with the opposite major side of an immediately preceding newspaper. As this is occurring, the open or cut edge portion of the newspaper is advantageously located in the pocket in order to maintain the newspaper in the desired orientation.

When a newspaper is moved into abutting engagement with a preceding newspaper, the two newspapers are in an underlapped relationship which is unsatisfactory for stacking purposes. Therefore, the underlapped newspapers are moved through an inverter which forms them into an overlapped stream which moves onto an outlet conveyor. The headline sides of the newspapers in the overlapped stream face downwardly so that address labels can be applied by an applicator mechanism disposed beneath the stream of newspapers.

Accordingly, it is an object of this invention to provide a new and improved method and apparatus for transferring newspapers from pockets into an overlapped stream with a closed or folded edge portion of each of the newspapers leading and a headline side of each of the newspapers facing downwardly and wherein a closed edge portion of a newspaper is accelerated in the direction of movement of a pocket to a speed which exceeds the speed of movement of the pocket while a trailing portion of the newspaper is disposed in the pocket.

Another object of this invention is to provide a new and improved method and apparatus for transferring newspapers having open and closed edge portions from pockets into an overlapped stream with closed edge portions of each of the newspapers leading and with a headline side of each of the newspapers facing downwardly and wherein the closed edge portions of the newspapers are accelerated to a speed which exceeds the speed of the pockets and the headline side of each newspaper is moved into abutting engagement with an immediately preceding newspaper prior to changing the orientation of the newspapers to form them into an overlapped stream.

Another object of this invention is to provide a new and improved method and apparatus for transferring newspapers from pockets in a newspaper stuffing machine into an overlapped stream with a closed edge portion of each of the newspapers leading and with a headline side of each of the newspapers facing downwardly and wherein a closed edge portion of each newspaper is accelerated to a speed which is greater than the speed of movement of the pockets while the closed edge portion of the newspaper is moved downwardly away from the pockets.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
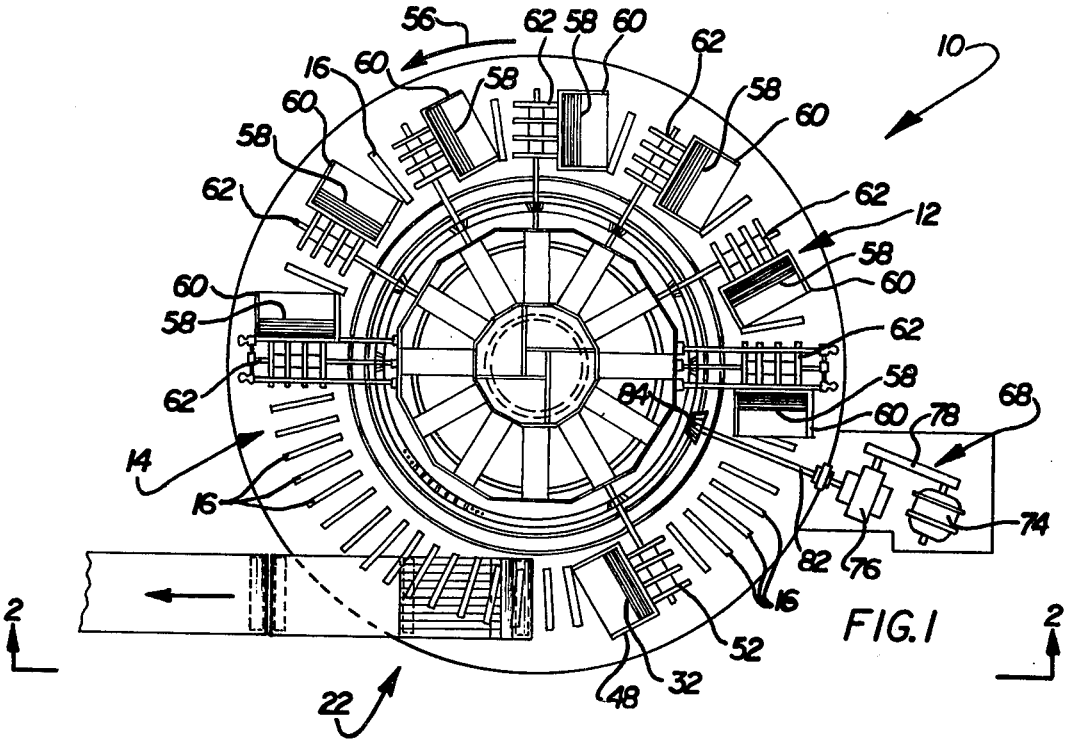
FIG. 1 is a plan view of a newspaper stuffing machine constructed in accordance with the present invention.
Figure 2:
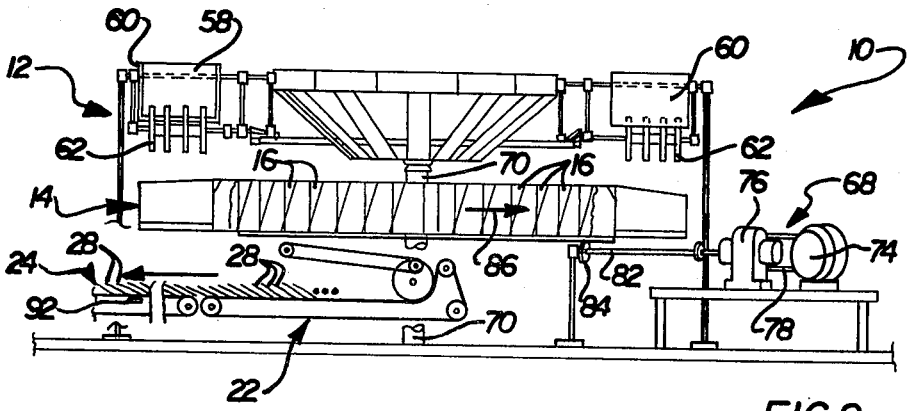
FIG. 2 is an elevational view, taken generally along the line 2—2 of FIG. 1, and illustrating the relationship between a newspaper section feed mechanism, a rotor, and a delivery conveyor assembly of the newspaper stuffing machine of FIG. 1.

A newspaper stuffing or assembling machine 10 (FIGS. 1 and 2) is operable in a known manner to stuff or assemble newspapers. The newspaper stuffing machine 10 includes a stationary newspaper infeed mechanism 12 which is disposed directly above a movable rotor 14 having a plurality of bottom opening pockets 16. During operation of the newspaper stuffing machine 10, a delivery conveyor assembly 22 is used to transfer newspapers 28 from the pockets 16 into an overlapped stream 24. Folded or closed edge portions of the newspapers 28 in the stream 24 are leading and headline sides of the newspapers are facing downwardly.

Each of the newspapers 28 in the overlapped stream 24 has a jacket or folded outer cover section 32 (FIG. 3) into which inner sections are stuffed during operation of the machine 10. The jacket 32 has a folded or closed edge portion 34 and a cut or open edge portion 36. A headline side 38 of the jacket 32 extends between the folded edge portion 34 and one of the cut or open edge portions 36. Similarly, a back side 40 extends between the closed edge portion 34 and the other cut or open edge portions 36.

Figure 3:
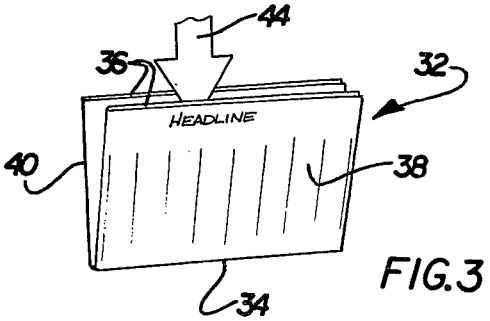
FIG. 3 is a schematic illustration of the manner in which a newspaper is stuffed and assembled with the machine of FIGS. 1 and 2.

During operation of the newspaper stuffing or assembling machine 10, the inner sections of the newspapers are inserted into the open jacket 32, in the manner indicated schematically by the arrow 44 in FIG. 3, to form a complete newspaper. Thus, the newspaper infeed mechanism 12 includes a jacket hopper 48 (FIG. 1) in which a plurality of the jackets 32 are located. The jackets 32 are sequentially fed from the hopper 48 into the pocket 16 of the rotor 14 by a sheet feed mechanism 52 with the headline sides 38 of the jackets facing in the direction of movement of the pockets 16. As the rotor 14 moves the pockets 16 in a counterclockwise direction (FIG. 1) indicated by the arrow 56, inner sections 58 are fed from hoppers 60 by sheet feed mechanisms 62. Of course, the number of inner sections fed from the hoppers 60 will vary depending upon the size of a particular newspaper.

A drive mechanism 68 rotates the rotor 14 about a stationary centerpost 70 (FIG. 2) so that the open upper ends of the pockets 16 sequentially move past the jacket feed hopper 48 and each of the inner section feed hoppers 60. The drive assembly 68 includes a motor 74 which is connected with a speed reducer 76 by a belt 78. During operation of the motor 74, a drive shaft 82 rotates a pinion gear 84 which is disposed in meshing engagement with a ring gear fixedly connected with the rotor 14. Rotation of the pinion gear 86 rotates the rotor 14 in a counterclockwise direction as viewed in FIG. 1, that is, in the direction of the arrow 86 in FIG. 2.

As each of the pockets 16 moves past the delivery conveyor assembly 22, a cam control mechanism effects movement between opposite sides of the pocket to open the lower end portion of the pocket. As a pocket 16 opens, a newspaper 28 in the pocket is dropped, under the influence of gravity, downwardly to the delivery conveyor assembly 22. The manner in which the newspaper stuffing or assembling machine 10 is constructed is generally the same as is disclosed in U.S. Pat. No. 2,461,573 and will not be further described herein.

When the newspapers 28 are being transported in the pockets 16, the headline side 38 (see FIG. 3) of the jacket 32 faces forwardly in the direction of movement of the pocket. The opposite side 40 of the jacket faces rearwardly. The folded or closed edge portion 34 of the newspaper is disposed at the bottom of the pocket.

When a pocket 16 is opened to release a newspaper 28 at the delivery conveyor assembly 22, the folded or closed edge portion 34 of the newspaper jacket moves downwardly through the open lower end portion of the pocket into engagement with the delivery conveyor assembly. At this time, the headline side 38 of the newspaper jacket 32 is facing fowardly, that is in the same direction indicated by the arrow 86 in FIG. 2.

The delivery conveyor assembly 22 engages each of the newspapers 28 in turn and forms them into the overlapped stream 24 with the closed or folded edge portion 34 of the newspaper jacket 32 leading and the headline side 38 facing downwardly. By having the headline side 38 facing downwardly, an address label applicator mechanism 92 (FIG. 2), disposed beneath the overlapped stream 24 can apply address labels to the headline side 38 of the jacket. The label applicator 92 is located between and beneath spaced apart belts which transport the overlapped stream 24 of newspapers 28. The label applicator 92 could be disposed at a location other than immediately adjacent to the newspaper stuffing or assembling mechanism 10 if desired.

The delivery conveyor assembly 22 (FIG. 4) includes a receiving conveyor 96 which receives newspapers 28 from the bottom opening in pockets 16 on the rotor 14. The newspapers 28 are first formed into an underlapped relationship (FIG. 8) with the closed folded edge portion 34 of the jackets 32 leading. The underlapped newspapers 28 enter an inverter 100 which changes the orientation of the newspapers to an overlapped relationship. The newspapers 28 leave the inverter 100 and move onto an outlet conveyor 102 in an overlapped stream. The outlet conveyor 102 transports the newspapers 28 in an overlapped stream to a conveyor 104 which transports the newspapers to a suitable stacking device.

While the newspapers 28 are travelling in an overlapped stream along the spaced apart belts of the conveyor 104, the label applicator 92 (FIG. 2) applies a label to the downwardly facing headline side 38 of the outer jacket 32 of the newspapers at a location adjacent to the open or cut edge 36 of the jacket. Therefore, the newspapers enter a stacker assembly (not shown) in an overlapped stream with the address labels applied to the headline side 38 of the newspaper jacket adjacent to the cut or open edge portion 36 of the jacket.

Figure 4:
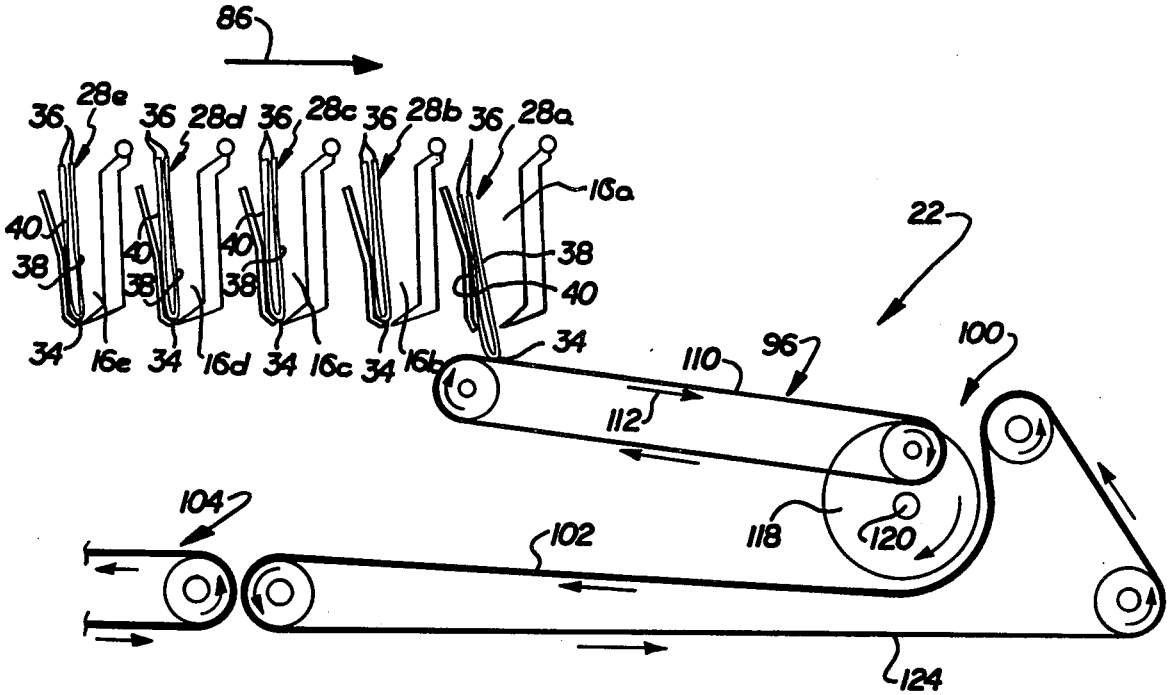
FIG. 4 is an enlarged schematic illustration of the delivery conveyor assembly, illustrating the manner in which a closed edge portion of a newspaper engages a receiving conveyor upon opening of a pocket in the rotor of the newspaper stuffing machine.

During operation of the newspaper stuffing machine 10, the pockets 16 enter the transfer station while moving in the direction of the arrow 86 (see FIG. 4). When a pocket 16*a* (see FIG. 4) moves over the receiving conveyor 96, the lower or bottom portion of the pocket 16*a* opens so that the closed edge portion of the jacket of a newspaper 28*a* in the pocket 16*a* engages an upper run 110 of the receiving conveyor 96. The upper run 110 of the receiving conveyor 96 is formed by a plurality of spaced apart belts moving in the direction indicated by the arrow 112 at a speed which is greater than the speed at which the pockets 16 move forwardly in the direction of arrow 86. Therefore, the upper run 110 of the receiving conveyor 96 accelerates the closed edge portion 34 of the newspaper 28*a*. As the receiving conveyor 96 accelerates the closed lower edge portion 34 of the newspaper 28*a* relative to the open upper edge portion 36 of the newspaper, the newspaper is deflected or bent in the manner shown in FIG. 5. The open upper edge portion 36 of the newspaper 28*a* remains in the pocket 16*a* while the closed lower edge portion 34 of the newspaper is being accelerated by the receiving conveyor 96. Therefore, the open upper edge portion 36 of the newspaper 28*a* is held against sidewise movement relative to the upper run 110 of the receiving conveyor 96 by the sides of the pocket 16*a*.

The inverter 100 includes a pair of turning drums 118 which are disposed between belts forming the receiving conveyor 96. The turning drums 118 are rotated about their central axis 120 at a surface speed which is less than the surface speed of the upper run 110 of the conveyor assembly 96. A single, relatively wide belt 124 cooperates with the drums 118 to sequentially move the newspapers through the inverter 100 to the outlet conveyor 102. The belt 124 forms a part of both the inverter 100 and the outlet conveyor 102. Of course separate belts could be used in the inverter 100 and outlet conveyor 102.

The belt 124 moves at a surface speed which is the same as the surface speed of the inverting drums 118. Therefore, when a newspaper enters the nip between the belt 124 and the inverting drums 118, the speed of forward movement of the newspaper is reduced. This results in the next succeeding newspaper moving closer to the newspaper disposed in the nip between the drums 118 and the belt 124.

Figure 5:
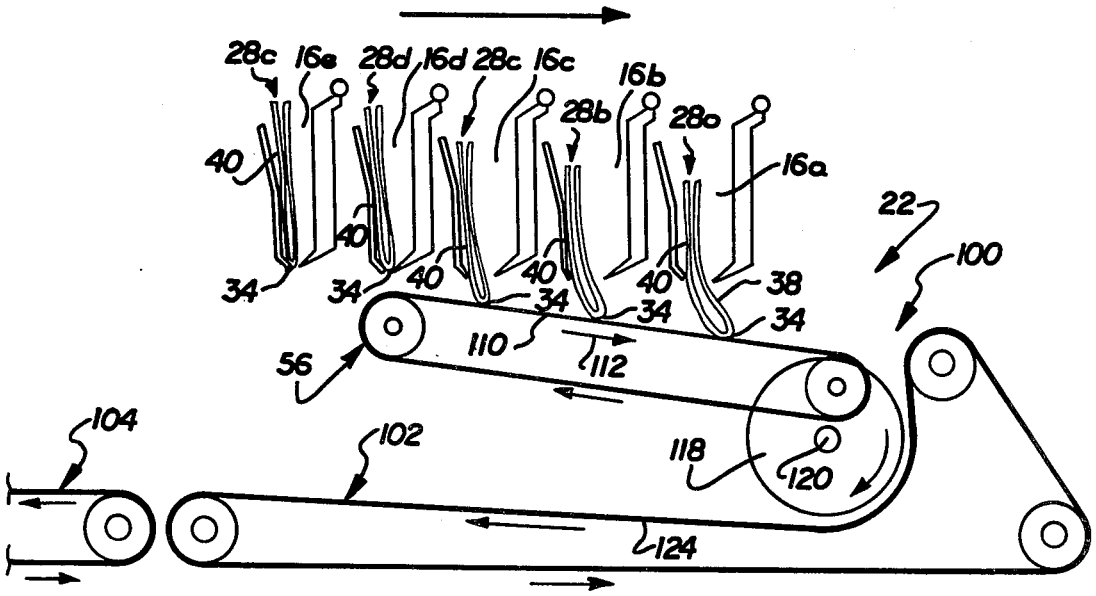
FIG. 5 is a schematic illustration, generally similar to FIG. 4, illustrating the manner in which the closed edge portions of a plurality of newspapers engage the receiving conveyor and are accelerated relative to the pockets by the receiving conveyor.
Figure 6:
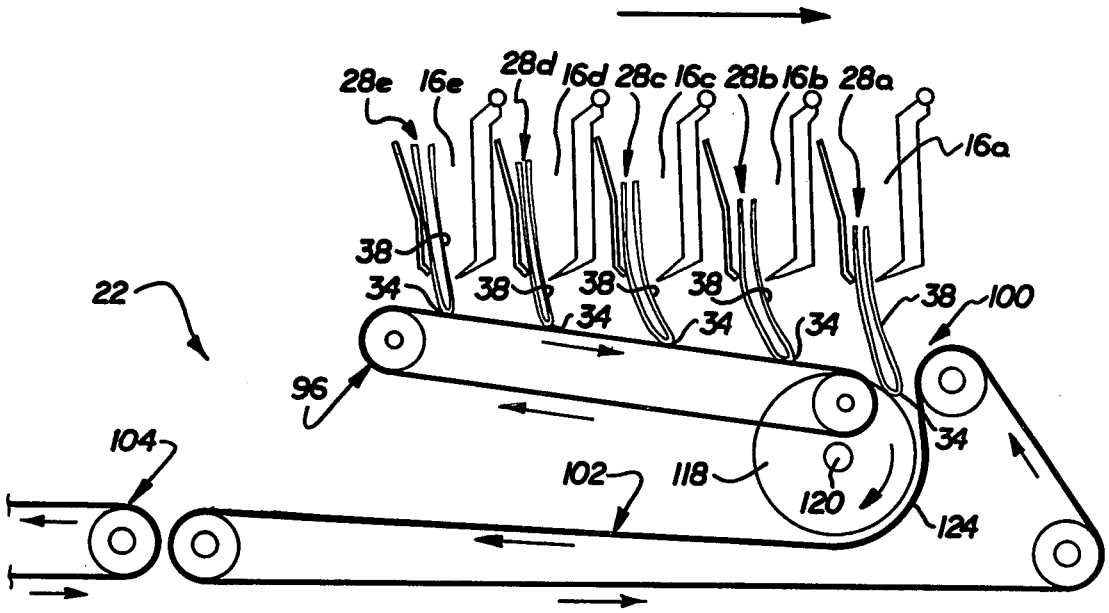
FIG. 6 is a schematic illustration, generally similar to FIG. 5, illustrating the manner in which an accelerated leading edge portion of a newspaper enters an inverter in the delivery conveyor assembly.

As the deflected newspaper 28*a* moves forwardly from the position shown in FIG. 5 to the position shown in FIG. 6, the closed lower edge portion 34 of the newspaper approaches a nip formed between the inverting drums 118 and the relatively wide belt 124. A portion of the belt 124 extends along the inverting drums 118 and, when there is no newspaper in the nip between the drums and the belt, engages the inverting drums.

As the newspaper 28*a* moves into the nip between the inverting drums 118 and belt 124, a trailing open edge portion 36 of the newspaper moves out of the open end of the pocket 16*a*. However, as the trailing edge portion 36 of the newspaper 28*a* is moving out of the open lower end of the pocket 16*a*, the leading folded edge portion 34 is already in the nip of the inverter 100. Therefore, the belt 124 and inverter drums 118 cooperate to hold the newspaper 28*a* against sidewise movement as the trailing edge of the newspaper is released from the pocket 16*a*. This results in the newspapers being positively held either by the pockets 16 or by the inverter 100 as they are fed from the pockets into the inverter.

Figure 7:
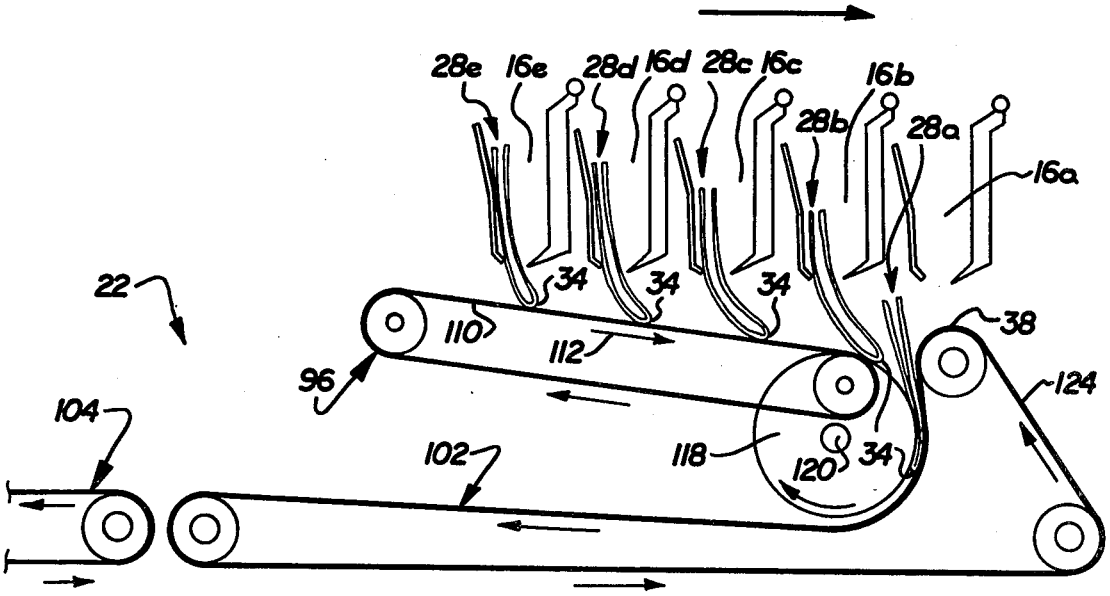
FIG. 7 is a schematic illustration generally similar to FIG. 6, illustrating the manner in which a newspaper proceeds through the inverter and a next succeeding newspaper enters the inverter.
Figure 8:
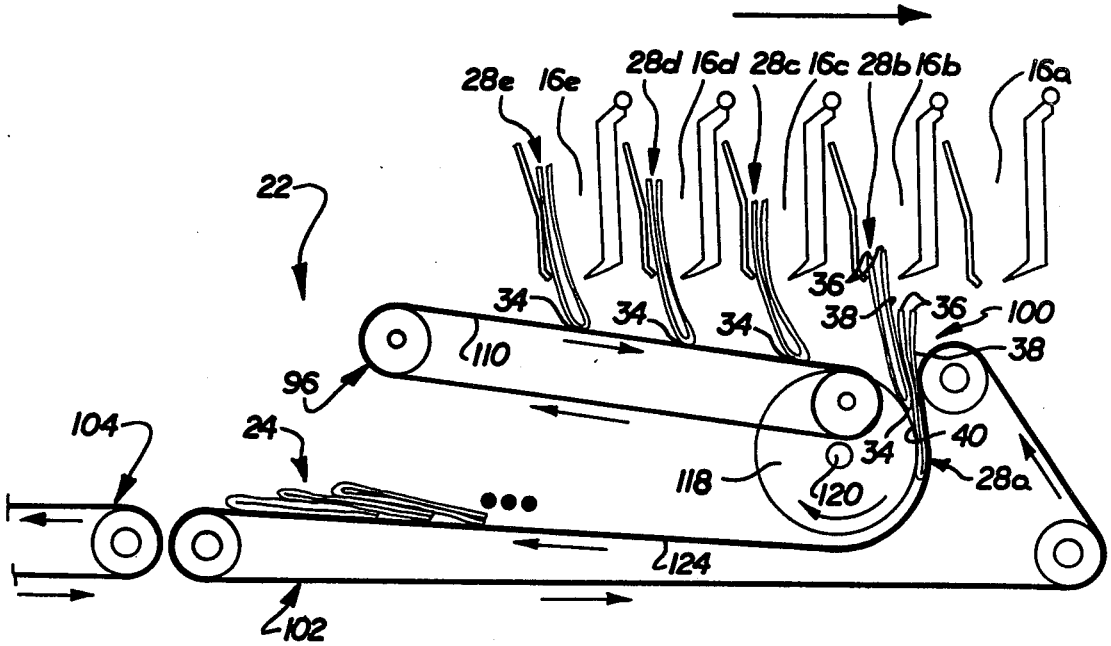
FIG. 8 is a schematic illustration, generally similar to FIG. 7, illustrating the manner in which a headline side of a newspaper engages a side of a preceding newspaper with the two newspapers in an underlapped relationship.

After a leading newspaper 28*a* has moved into the inverter 100 between the belt 124 and inverting drums 118 (see FIG. 7) the headline side 38 of the next succeeding newspaper 28*b* moves into flat abutting engagement with the trailing side 40 of the preceding newspaper 28*a* in the manner shown in FIG. 8. This results in the newspapers entering the inverter 100 in an underlapped relationship. It should be noted that as the succeeding newspaper 28*b* moves into abutting engagement with the preceding newspaper 28*a* (FIGS. 7 and 8) and enters the nip of the inverter 100, the open trailing edge portion 36 of the newspaper 28*b* is still in the pocket 16*b*. Therefore, the trailing newspaper 28*b* is held against sidewise movement relative to the delivery conveyor assembly 22 by engagement of the trailing open edge portion 36 of the newspaper 28*b* with the pocket 16*b* and by abutting engagement of the leading closed edge portion 34 of the newspaper with the nip of the inverter 100.

The inverter 100 changes the orientation of the newspapers 28*a* and 28*b* from the underlapped orientation shown in FIG. 8 to an overlapped orientation. Thus, the newspapers 28 leave the inverter 100 in an overlapped stream with the headline side 38 down. This results in an overlapped stream 24 of newspapers being conducted by the outlet conveyor 102 away from the inverter 100 with the headline side 38 of the newspapers facing downwardly to enable an address label to be applied to the headline side of the newspaper.

The receiving conveyor 96 slopes downwardly toward the inverter 100. Therefore, as the closed lower edge portion 34 of the newspapers are accelerated, they are moved downwardly and the newspapers are bent forwardly in the manner shown in FIGS. 6–8. As the closed lower edge portions 34 of the newspapers are accelerated by the receiving conveyor 96, the spacing between the folded edge portions remains constant because they are all being accelerated by the upper run 110 of the receiving conveyor 96.

When the folded edge portion 34 of a newspaper engages the inverter drums 118 (FIG. 6), the edge portion is decelerated because the inverter drum 118 and conveyor belt 124 are moving at a slower speed than the upper run of the receiving conveyor 96. This results in a decrease in the distance between the closed edge portion 34 and the leading newspaper 28*a* and the closed edge portion 34 of a next succeeding newspaper 28*b*.

Figure 9:
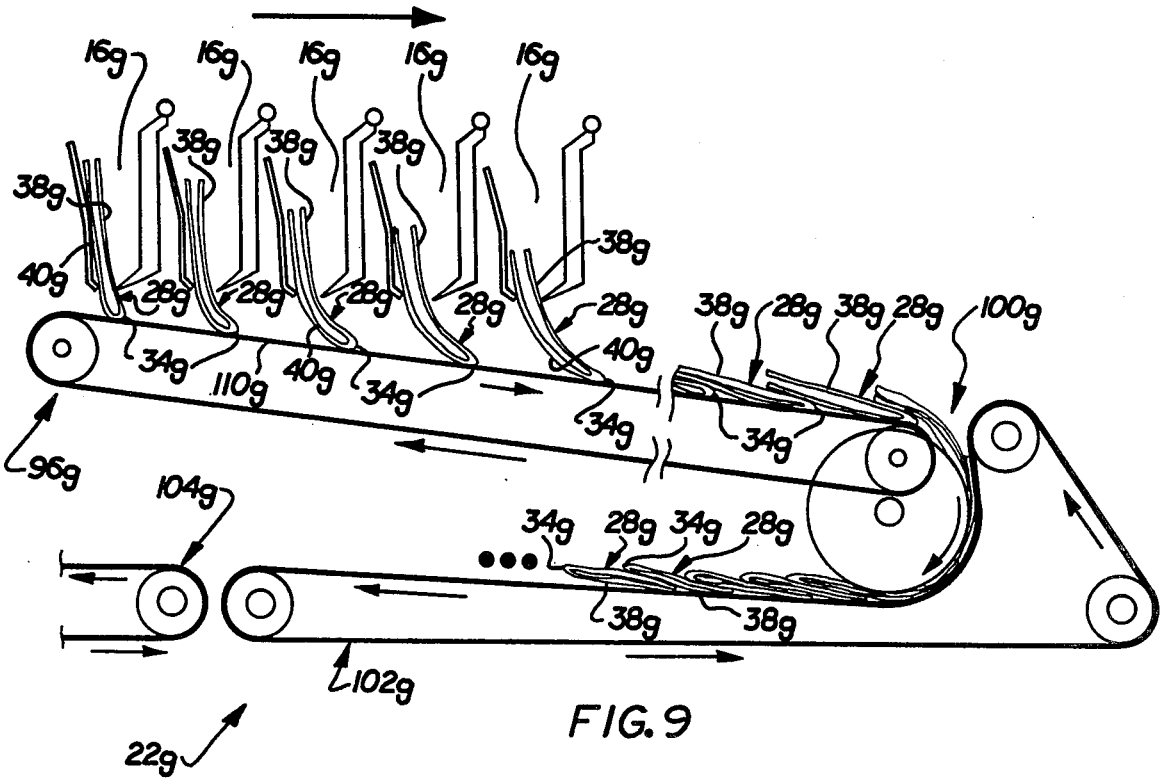
FIG. 9 is a fragmentary schematic illustration of a second embodiment of the invention in which the newspapers are deposited in an underlapped stream on the receiving conveyor before being transferred to the inverter.

In the embodiment of the invention shown in FIGS. 1–8, the newspapers 28 are moved into an underlapped relationship as they are received in the inverter 100 (see FIG. 8). This allows the trailing open edge portion 36 of the newspapers to be restrained against sidewise movement by the pockets 16 while the leading closed edge portions 34 of the newspapers are being accelerated. However, it is contemplated that it may be desirable to form the newspapers into an underlapped stream on the receiving conveyor. An embodiment of the invention in which the newspapers are formed into an underlapped stream on the receiving conveyor before entering the inverter is shown in FIG. 9. Since components of the invention shown in FIG. 9 are similar to the components of the invention shown in FIG. 8, similar numerals will be used to designate similar components, the suffix letter "g" being associated with the numerals of FIG. 9 to avoid confusion.

In the embodiment of the invention shown in FIG. 9, a delivery conveyor assembly 22*g* has a relatively long receiving conveyor 96*g* which receives the newspapers 28*g* from the pockets 16*g*. When the pockets 16*g* are over the receiving conveyor 96*g*, the bottoms of the pockets 16*g* open and the closed lower edge portions 34*g* of the newspapers engage the upper run 110*g* of the delivery conveyor 96*g*. As the newspapers are accelerated by the receiving conveyor 96*g* and moved downwardly away from the pockets 16*g*, the leading closed edge portion 34*g* of one newspaper moves under the trailing major side 40*g* of the preceding newspaper so that the newspapers are formed in an underlapped stream with the headline sides 38*g* facing upwardly in the manner shown at the right on the receiving conveyor 96*g*.

The underlapped stream of newspapers enters the inverter 100*g* which changes the orientation of the newspapers to form an overlapped stream of newspapers on the outlet conveyor 102*g*. The overlapped stream of newspapers on the outlet conveyor 102*g* have folded closed edge portions 34*g* leading and headline sides 38*g* facing downwardly.

In view of the foregoing description it is apparent that the present invention provides a new and improved method and apparatus for transferring newspapers from pockets 16 of the high speed stuffing machine 10 into an overlapped stream 24 with closed edge portions 34 of the newspapers leading and with headline sides 38 of the newspapers facing downwardly. The downwardly facing headline sides 38 of the newspapers 28 are accessible to an address label applicator 92 disposed beneath the stream 24 of newspapers 28. Since the stream 24 of newspapers 28 is in an overlapped relationship with the closed edge portions 34 of the newspapers leading, the addressed newspapers can be readily stacked with known equipment.

During operation of the stuffing machine 10, newspapers 28 sequentially move into a transfer station at a relatively high speed with the headline side 38 of each of the newspapers facing in the direction of movement of the pockets 16. Upon opening of a stuffing machine pocket 16, a closed edge portion 34 of a newspaper 28 moves out of the pocket 16 into engagement with the downwardly sloping receiving conveyor 96. The conveyor 96 accelerates the closed edge portion 34 of a newspaper 28 while the open trailing edge portion 36 of the newspaper remains in the open pocket 16. The newspaper 28 is held against movement from its intended path by engagement of the open or cut edge portion 36 of the newspaper with the sides of the pocket 16 while the closed or folded edge portion 34 of the newspaper is being accelerated.

The headline side 38 of the newspaper is moved into abutting engagement with the opposite major side 40 of an immediately preceding newspaper. As this is occurring, the open or cut edge portion 36 of the newspaper 28 is still located in the pocket 16 in order to maintain the newspaper in the desired orientation.

When a newspaper 28 is moved into abutting engagement with a preceding newspaper, the two newspapers are in an underlapped relationship (FIG. 8) which is generally unsatisfactory for stacking purposes. Therefore, the underlapped newspapers 28 are moved through an inverter 100 which forms them into an overlapped stream 24 on an outlet conveyor 102. The headline side 38 of the newspapers 28 in the overlapped stream 24 face downwardly so that an address label can be applied by an applicator mechanism 92 disposed beneath the stream of newspapers.

Having described specific preferred embodiments of the invention, the following is claimed:

1. An apparatus for transferring newspapers into an overlapped stream from pockets moving in a first direction at a first speed, said apparatus comprising means for sequentially engaging the closed edge portion of each of the newspapers in turn as it moves out of a pocket, for accelerating the closed edge portion of an engaged newspaper in the first direction to a second speed which is greater than the first speed while an open edge portion of the newspaper is disposed in a pocket which is moving at the first speed and for moving a first major side of each one of the newspapers in turn and a second major side of an immediately preceding newspaper into abutting engagement with the open edge portion of the one newspaper disposed in a pocket, and means for forming the newspapers into an overlapped stream with the closed edge portion of each of the newspapers leading and with the first major side of each of the newspapers facing downwardly.

2. An apparatus as set forth in claim 1 wherein said means for forming the newspapers into an overlapped stream includes inverter means for engaging the newspapers in an underlapped relationship and changing the relationship of the newspapers to an overlapped relationship.

3. An apparatus as set forth in claim 1 wherein said means for engaging the closed edge portions of the newspapers includes first conveyor means having an upper run which slopes downwardly away from the pockets in the first direction and means for driving said upper run of said first conveyor means at the second speed.

4. An apparatus as set forth in claim 3 further including second conveyor means having a run disposed beneath said upper run of said first conveyor means, said means for forming the newspapers into an overlapped stream including inverter means extending between said first and second conveyor means for changing the orientation of the newspapers from a first orientation in which the first major sides of the newspapers face in one direction to an orientation in which the first major sides of the newspapers face downwardly.

5. A method comprising the steps of moving pockets containing newspapers having open and closed edge portions in a first direction at a first speed, moving the closed edge portion of each of the newspapers in turn out of a pocket, accelerating the closed edge portion of a newspaper in the first direction to a second speed which is greater than the first speed while the open edge portion of the newspaper is in a pocket moving at the first speed and the closed edge portion of the newspaper is out of the pocket, moving a first major side of each one of the newspapers in turn and a second major side of a newspaper immediately preceding the one newspaper into abutting engagement with the open edge portion of the one newspaper in a pocket, and, thereafter, forming the newspapers into an overlapped stream with the closed edge portion of each of the newspapers leading and with the first major side of each of the newspapers facing downwardly.

6. A method as set forth in claim 5 wherein said step of moving major sides of newspapers into abutting engagement is performed after accelerating the closed edge portion of the one newspaper to the second speed.

7. A method as set forth in claim 6 wherein said step of moving major sides of newspapers into abutting engagement is performed while the closed edge portion of the one newspaper is traveling in the first direction at the second speed.

8. A method as set forth in claim 5 wherein said step of moving major sides of newspapers into abutting engagement includes positioning the newspapers in an underlapped relationship, said step of forming the newspapers into an overlapped stream includes changing the relationship of the engaged newspapers from an underlapped relationship to an overlapped relationship.

9. A method as set forth in claim 5 further including the step of moving the closed edge portion of a newspaper downwardly away from the pockets simultaneously with performance of said step of accelerating the closed edge portion of a newspaper to the second speed.

10. An apparatus for transferring newspapers having open and closed edge portions from pockets moving the newspapers in a first direction at a first speed with first major sides of the newspapers facing in the first direction into an overlapped stream with closed edge portions of the newspapers leading and the first major sides of the newspapers facing downwardly, said apparatus comprising means for sequentially engaging the closed edge portions of each of the newspapers, for accelerating the closed edge portions of the engaged newspapers in the first direction to a second speed which is greater than the first speed while the open edge portions of the newspapers are disposed in the pockets which are moving at the first speed and for moving the first major side of each one of the newspapers in turn and a second major side of an immediately preceding newspaper into abutting engagement with the closed edge portion of the one newspaper disposed in engagement with the central portion of the second major side of the preceding newspaper while the one newspaper and the preceding newspaper are in a first orientation, and means for changing the orientation of each of the newspapers in turn from the first orientation to a second orientation while maintaining the first major side of each newspaper in abutting engagement with the second major side of the preceding newspaper, said means for changing the orientation of each of the newspapers in turn from the first orientation to the second orientation including means for forming the newspapers into an overlapped stream with the closed edge portion of each of the newspapers leading and with the first major side of each of the newspapers facing downwardly.

11. An apparatus as set forth in claim 10 wherein said means for engaging closed edge portions of newspapers, for accelerating closed edge portions of newspapers and for moving the first and second major sides of newspapers into engagement includes means for moving the major sides of the one newspaper and the preceding newspaper into abutting engagement while the open edge portion of the one newspaper is disposed in a pocket.

12. An apparatus as set forth in claim 10 wherein said means for changing the orientation of each of the newspapers in turn includes means for engaging the newspapers in an underlapped relationship while the newspapers are in the first orientation and for changing the relationship of the newspapers to an overlapped relationship while the newspapers are in the second orientation.

13. An apparatus as set forth in claim 10 wherein said means for engaging the closed edge portion of the newspapers, for accelerating closed edge portions of the newspapers and for moving the first and second major sides of the newspapers into engagement includes conveyor means having a run which slopes downwardly away from the pockets in the first direction.

14. A method of transferring newspapers from a plurality of bottom opening pockets in a delivery mechanism into an overlapped stream, said method comprising the steps of operating the delivery mechanism to sequentially move each of the pockets in turn into a transfer station at a first speed with newspapers disposed in a generally upright orientation in the pockets with closed edge portions of the newspapers downward and a first major side of each newspaper facing in the direction of movement of the pockets into the transfer station, opening a bottom portion of each of the pockets in turn at the transfer station, moving the closed edge portions of each of the newspapers in turn out of an open pocket, accelerating the closed edge portion of a newspaper in the direction of movement of the pockets to a second speed which is greater than the first speed while moving the closed edge portion of the newspaper downwardly away from the pockets, moving the first major side of each one of the newspapers in turn and a second major side of a newspaper immediately preceding the one newspaper into abutting engagement while the closed edge portion of the one newspaper is moving at the second speed, and, thereafter, forming the newspapers into an overlapped stream with the closed edge portion of each of the newspapers leading and with the first major side of each of the newspapers facing downwardly.

15. A method as set forth in claim 14 wherein said step of accelerating the closed edge portion of a newspaper is performed with the open end of the newspaper in a pocket.

16. A method as set forth in claim 14 wherein said step of moving major sides of newspapers into abutting engagement includes positioning the newspapers in an underlapped relationship, said step of forming the newspapers into an overlapped stream includes changing the relationship of the engaged newspaper from an underlapped relationship to an overlapped relationship.

17. A method of transferring newspapers into an overlapped stream from pockets moving in a first direction at a first speed, said method comprising the steps of sequentially engaging the closed edge portion of each of the newspapers in turn as it moves out of a pocket, accelerating the closed edge portion of an engaged newspaper in a first direction to a second speed which is greater than the first speed while an open edge of the newspapers is disposed in a pocket which is moving at the first speed and for moving a first major side of each one of the newspapers in turn and a second major side of an immediately preceding newspaper into abutting engagement with the open edge portion of one newspaper disposed in a pocket, and forming the newspapers into an overlapped stream with the closed edge portion of each of the newspapers leading and with the first major side of each of the newspapers facing downwardly.

* * * * *